United States Patent [19]

Clarke

[11] 4,181,195

[45] Jan. 1, 1980

[54] LADDER LOCK

[76] Inventor: Clifford R. Clarke, 2782 Elysium, Eugene, Oreg. 97401

[21] Appl. No.: 877,172

[22] Filed: Feb. 13, 1978

[51] Int. Cl.[2] ..... E06C 5/32; E06C 7/00

[52] U.S. Cl. ..... 182/230; 182/129; 182/106

[58] Field of Search ..... 182/106, 230; 49/57; 292/202, 204; 70/406

[56] References Cited

U.S. PATENT DOCUMENTS

| | | | |
|---|---|---|---|
| 2,876,047 | 3/1959 | LaPlante | 182/121 |
| 2,880,829 | 4/1959 | Watkins | 52/173 |
| 3,418,833 | 12/1968 | Kerr | 70/406 |

*Primary Examiner*—Reinaldo P. Machado
*Attorney, Agent, or Firm*—Kolisch, Hartwell, Dickinson & Stuart

[57] ABSTRACT

A ladder locking device designed for attachment to a frame-mounted ladder. The ladder lock includes a panel dimensioned to cover the front side of the ladder over an area including a plurality of ladder rungs. The upper edge of the panel is bent to form a lip engageable with an upper ladder rung. Attached to a lower portion of the panel is a lock operable to position a locking member into engagement or disengagement with a lower ladder rung, whereby the device is locked to or released from the ladder.

3 Claims, 5 Drawing Figures

LADDER LOCK

BACKGROUND AND SUMMARY

The present invention relates to ladder locking devices, and in particular, to devices designed for preventing climbing access to recreational vehicle-mounted ladders.

It is often desirable to be able to prevent climbing access to ladders, for example, where ladders present an attractive nuisance to children, or where ladders provide ready access to vehicles, buildings, or towers. The particular application contemplated in the present invention is preventing climbing access to ladders permanently mounted on recreational vehicles.

As is known, conventional motor homes and campers have an open storage area for tools, tires, and the like on top of the vehicle. Access to this area is by means of a permanently affixed ladder on the side or back of the vehicle. A common problem is that when the vehicle is unattended, intruders steal goods stored on top or children climb up to that dangerous area.

It is an object of the present invention to provide a simple ladder lock for effectively preventing climbing access to a frame-mounted ladder.

It is another object of the invention to provide a ladder lock which can be easily locked to and unlocked from a conventional vehicle-mounted ladder.

It is yet another object of the invention to provide such a ladder lock requiring a key or the like to disengage the ladder lock from the ladder.

It is still another object of the invention to provide a ladder lock which is simple in construction, lightweight, and relatively inexpensive in manufacture.

To this end, the present invention comprises a panel dimensioned to cover the outwardly facing side of a frame-mounted ladder over an area including a plurality of ladder rungs, and a pair of fastening members for fastening the panel to the ladder. One of the fastening members has a permanently fixed position, and the other is selectively positionable between locking or unlocking positions. In such locking position, engagement or disengagement of the ladder lock with the ladder is prevented; in the unlocking position, such engagement or disengagement is allowed.

More specifically, the fixed fastening member is a lip integrally formed with the upper edge of the panel for engaging an upper ladder rung. The selectively operable member includes a lock attached to a lower portion of the panel. A locking arm associated with this lock is positionable, upon operating the lock, between a substantially vertical locking or a horizontal unlocking position, wherein the locking arm is engaged with or disengaged from, respectively, a lower ladder rung.

These and other objects and features of the present invention will now be described more fully with reference to the following detailed description of the invention and the accompanying drawings.

DETAILED DESCRIPTION OF THE INVENTION

Figure 1:
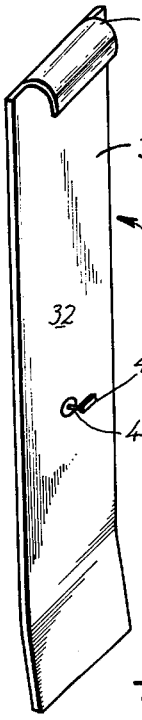
FIG. 1 is a perspective view of the ladder lock of the present invention as seen from the inwardly facing side of the lock.
Figure 2:
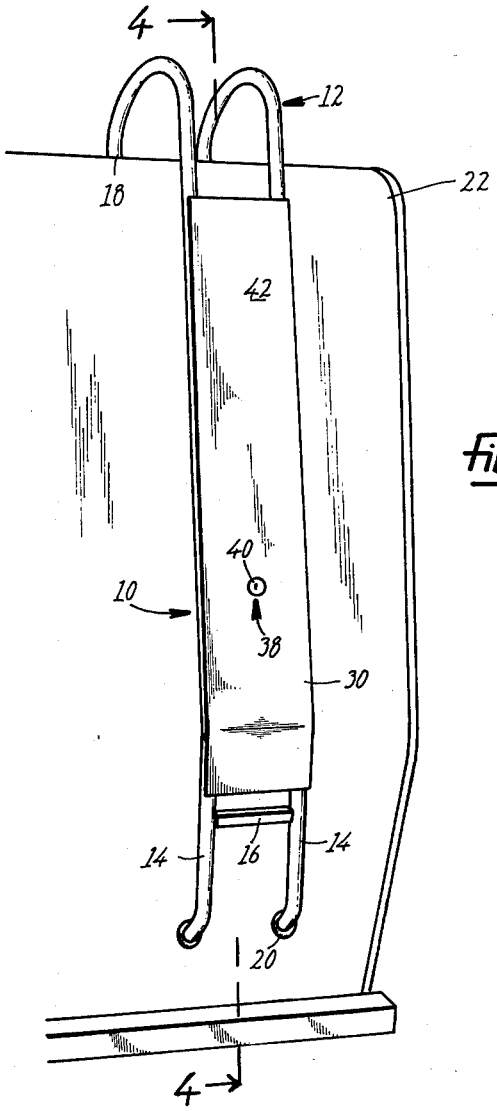
FIG. 2 is a perspective view of the same ladder lock attached to a vehicle-mounted ladder.

Referring now to FIG. 2, there is shown at 10 the ladder lock of the present invention, attached to a vehicle-access ladder 12. This ladder includes a pair of side rails 14 and a plurality of rungs 16 supported therebetween. The upper and lower ends 18 and 20 of each side rail are permanently secured to the top and side regions, respectively, of a motor home 22. Conventionally, ladder 12 provides access to the top area of the motor home, where tires, outdoor equipment, etc. may be stored.

Lock 10 generally comprises an elongate panel 30 and upper and lower fastening members which serve to fasten the panel to the ladder. The upper fastening member has a permanently fixed position and the lower member is selectively operable between locking or unlocking positions. In its locking position, the lower fastening member prevents engagement or disengagement of the ladder lock with the ladder. In its unlocked position, such engagement or disengagement is permitted.

The two fastening members are mounted on the inwardly-facing side 32 of the elongate panel and are vertically spaced from one another to engage spaced apart ladder rungs **16*a* and 16*b*. In the embodiment shown, the upper fixed positioned fastening member is a down-turned lip 34 which engages top and rear portions of upper ladder rung 16*a***.

The lower, selectively operable fastening member is a key-operated swivel lock 38 attached by conventional means to a lower portion of panel 30. Lock 38 includes a key slot 40 accessible from the outwardly-facing side 42 of the panel, and a lock cylinder 44, rotatably attached to the lock housing (not shown). The lock cylinder is operable to execute limited clockwise and counter-clockwise rotation upon operating the lock with a key. Attached to the end of the cylinder opposite the panel is a locking arm 48 which is positionable between a vertical locking position (solid line, FIG. 3) or a horizontal unlocking position (dotted line, FIG. 3).

Figure 4:
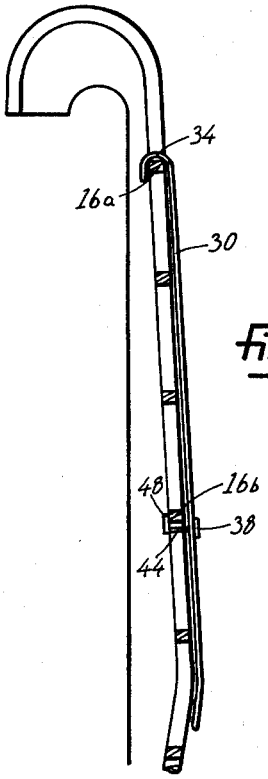
FIG. 4 is a cross-sectional view of the ladder-mounted ladder lock taken generally along line 4—4 of FIG. 2.
Figure 3:
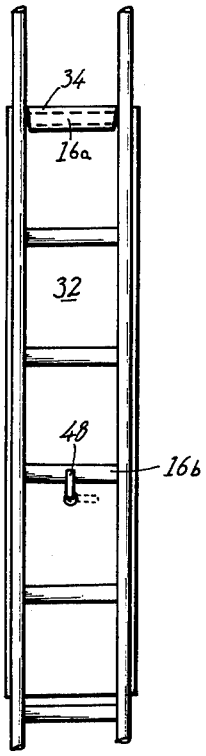
FIG. 3 shows the ladder-mounted ladder lock as seen from the inwardly facing side of the ladder lock.

As best seen in FIGS. 3 and 4, lock 38 is so located on panel 30 that the lock cylinder 44 lies directly below a lower ladder rung **16*b* when lip 34 is engaged with upper ladder rung 16*a***. This configuration prevents vertical shifting of the locking device on the ladder.

The ladder locking device is locked to the ladder by first hooking upper lip 34 over upper rung **16*a* and then swinging the lower end of the device inwardly to the position shown in the figures, the locking arm being positioned in its horizontal position. Lock 38 is then operated by a key or the like to shift locking arm 48 to its vertical, locking position. Locking arm 48 now engages a rear portion of lower rung 16*b***, preventing the lower end of the panel from being swung outwardly. The panel is thus locked to the ladder, and climbing access to the ldder is prevented.

When it is desired to use the ladder, locking arm 48 is shifted, by operating lock 38, to its horizontal unlocking position, whereby the lower end of the panel can be swung outwardly, allowing the lip 34 to be disengaged from the upper rung **16*a***.

It can be appreciated from the above that the spacing between lip 34 and lock 38 must approximate the distance between two spaced-apart ladder rungs 16. Generally, ladders provided on recreational vehicles have a common rung spacing, so that a single panel ladder lock of the type described above would fit a variety of different recreational vehicle ladders. However, to accommodate ladders having a rung spacing different from that conventionally encountered, a ladder lock having means for positioning the lock on the panel to produce a desired spacing between the lip and the lock is provided.

Figure 5:
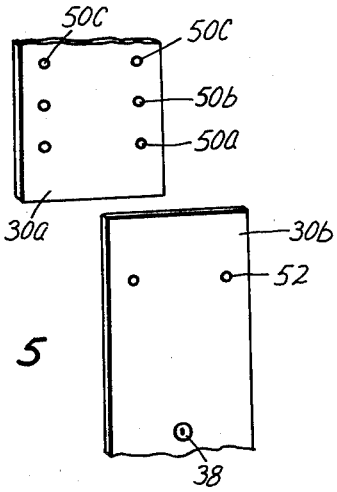
FIG. 5 is a fragmentary perspective view of two panel sections of a disassemblable ladder lock.

As shown in FIG. 5, the adjustable spacing ladder lock comprises upper and lower panels 30*a* and 30*b*. Adjacent the lower edge of upper panel 30*a*, opposite the edge bearing lip 34 (not shown), are three opposed pairs of vertically spaced rivet holes 50*a*, 50*b*, 50*c*. Adjacent the upper edge of lower panel 30*b*, is a single opposed pair of rivet holes 52. By riveting, or otherwise fastening panel 30*b* at holes 52 to panel 30*a* at holes 50*a*, 50*b*, or 50*c*, an elongate panel having a desired spacing between lip 34 and lock 38 is formed.

The above-described two panel ladder lock provides the additional advantage that the ladder lock may be shipped in two smaller sections which can be assembled on site.

While a preferred embodiment of the invention has been described herein, it should be apparant to those skilled in the art that other variations and modifications are possible without departing from the spirit of the invention.

It is claimed and desired to secure by Letters Patent:

1. A ladder locking device for use with a ladder having a pair of side rails and a plurality of rungs supported therebetween, said ladder being permanently mounted against a frame to permit climbing access from the outwardly-facing side of the ladder only, said locking device comprising, an elongate panel dimensioned to cover the outwardly-facing side of the ladder over an area covering a plurality of ladder rungs, the upper edge of said panel forming a lip fastenable to an upper ladder rung, a lock mounted on a lower portion of said panel, means for selectively positioning said lock on said panel to produce a desired spacing between said lock and said lip, and a locking arm attached to said lock, selectively positionable between locking and unlocking positions, wherein said locking arm engages and disengages, respectively, a lower ladder rung.

2. A ladder locking device for use with a ladder having a pair of side rails and a plurality of rungs supported therebetween, said ladder being permanently mounted against a frame to permit climbing access from the outwardly facing side of the ladder only, said locking device comprising, a first panel section, the upper edge of which forms a lip fastenable to an upper ladder rung, a second panel section including a lock mounted thereon, said second section being adjustably fastenable to said first section to form a single elongate panel having a preselected spacing between said lock and said lip, and a locking arm attached to said lock, selectively positionable between locking and unlocking positions, wherein said locking arm engages and disengages, respectively, a lower ladder rung.

3. The locking device of claim 2 wherein said lock is a swivel lock and said locking arm is spaced inwardly from the plane of said panel and selectively positionable between substantially vertical locking and horizontal unlocking positions.

* * * * *